US006834881B2

(12) United States Patent
Mash

(10) Patent No.: US 6,834,881 B2
(45) Date of Patent: Dec. 28, 2004

(54) SPORT BOARD

(76) Inventor: Paul Thomas Mash, 36109 Waltham Dr., Sterling Heights, MI (US) 48310

( * ) Notice: Subject to any disclaimer, the term of this patent is extended or adjusted under 35 U.S.C. 154(b) by 47 days.

(21) Appl. No.: 10/310,170

(22) Filed: Dec. 4, 2002

(65) Prior Publication Data

US 2003/0116941 A1 Jun. 26, 2003

Related U.S. Application Data

(60) Provisional application No. 60/338,772, filed on Dec. 4, 2001.

(51) Int. Cl.[7] ..... A63C 5/075

(52) U.S. Cl. ..... 280/607; 280/14.21

(58) Field of Search ..... 280/87.041, 87.042, 280/607, 617, 618, 634, 636, 842, 14.21, 14.22, 11.224, 11.225; 441/68, 70

(56) References Cited

U.S. PATENT DOCUMENTS

| | | | | | |
|---|---|---|---|---|---|
| 1,101,631 | A | * | 6/1914 | Jacques | 280/605 |
| 2,649,306 | A | * | 8/1953 | Hilding | 280/614 |
| 4,856,808 | A | * | 8/1989 | Longoni | 280/617 |
| 4,979,761 | A | * | 12/1990 | Rohlin | 280/607 |
| 5,069,473 | A | * | 12/1991 | Erdei | 280/605 |
| 5,775,716 | A | * | 7/1998 | Harsanyi et al. | 280/602 |
| 5,901,975 | A | * | 5/1999 | Phipps | 280/618 |
| 5,971,419 | A | * | 10/1999 | Knapschafer | 280/607 |
| 6,328,328 | B1 | * | 12/2001 | Finiel | 280/636 |

FOREIGN PATENT DOCUMENTS

| | | | | |
|---|---|---|---|---|
| DE | 2705199 | A1 * | 8/1978 | 280/607 |
| DE | 2929069 | * | 1/1980 | 280/607 |
| DE | 3712807 | * | 11/1988 | 280/607 |
| DE | 4112299 | * | 12/1991 | 280/607 |
| FR | 2673546 | * | 9/1992 | 280/617 |

* cited by examiner

*Primary Examiner*—Frank Vanaman
(74) *Attorney, Agent, or Firm*—The Weintraub Group, P.L.C.

(57) ABSTRACT

A shock absorption system for a sports board which includes a rocker assembly for attaching the board to a raised platform which rocks forward and aft on the board. A space between the platform and the board to accommodate two independent inflated bladders which create a cushion for the platform to rock into forward and aft. The pressure inside the bladders will be at the rider's desired psi and will be sufficient for the rider to exert extreme pressures for balance, control, and maneuvers on any given terrain conditions.

13 Claims, 3 Drawing Sheets

FIG 3
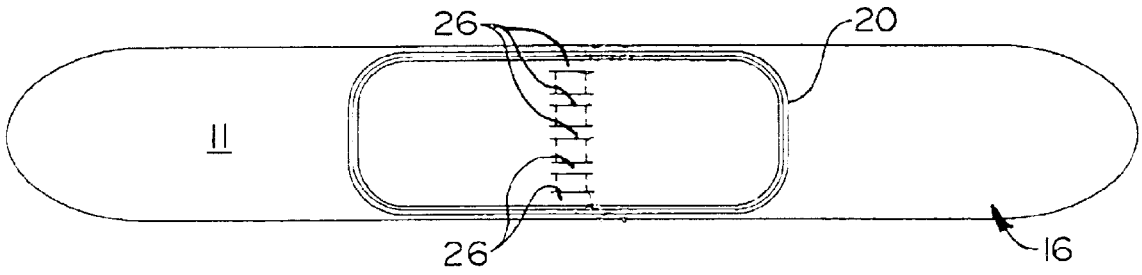
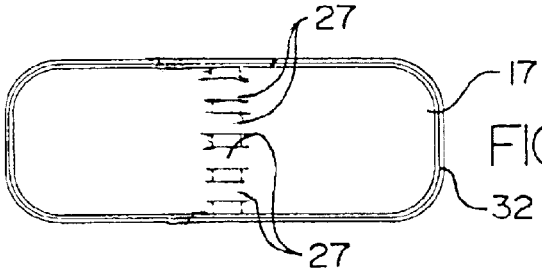
FIG 4
FIG 5
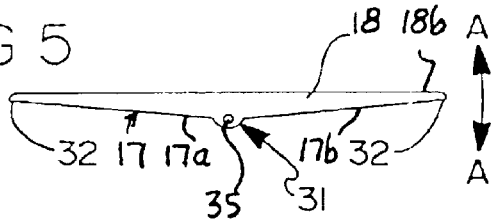
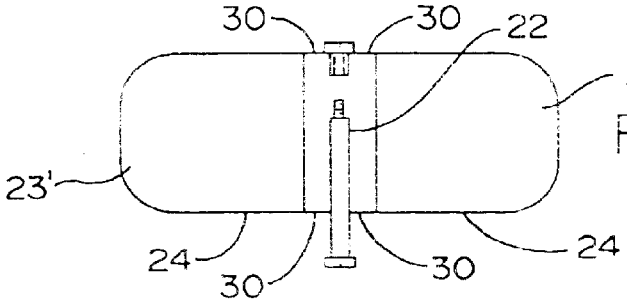
FIG 6

FIG 7
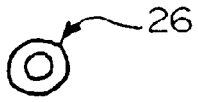
FIG 8
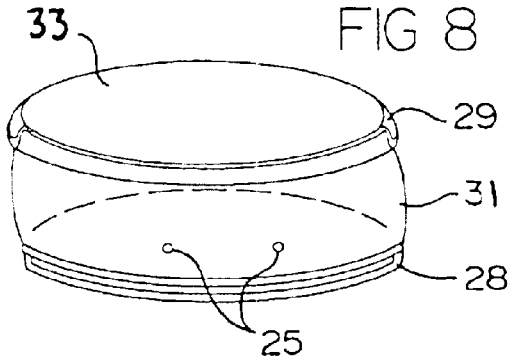
FIG 9
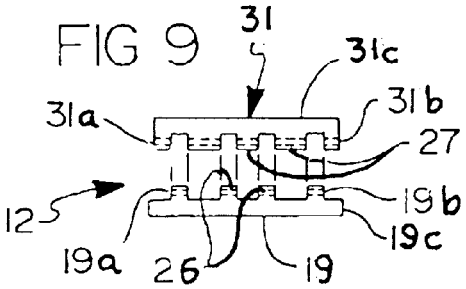
FIG 9A
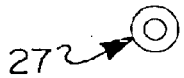
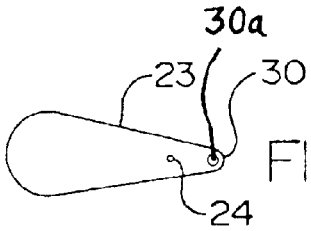
FIG 10
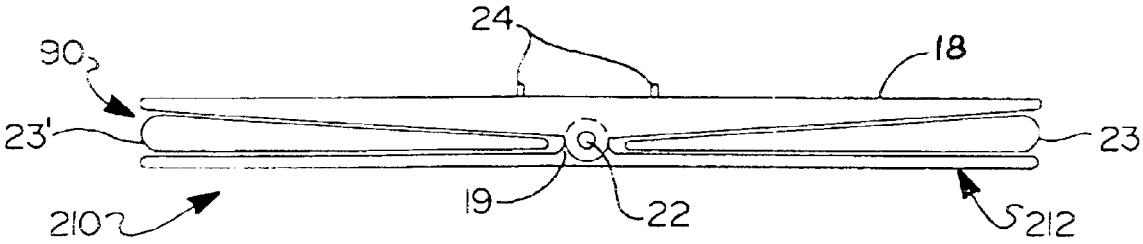
FIG 11

SPORT BOARD

CROSS-REFERENCE TO RELATED APPLICATION

This application is a completion application of United States Provisional Patent Application Ser. No. 60/338,772, filed Dec. 4, 2001, the disclosure of which is hereby incorporated by reference.

BACKGROUND OF THE INVENTION

1. Field of the Invention

The present invention pertains to sport boards. More particularly, the present invention concerns a shock absorbing system for a sport board. Even more particularly, the present invention concerns a universal shock absorbing system for a wide variety of sport boards.

2. Prior Art

In recent years, snowboarding, skate boarding, and water or aquatic board-related sports have continued to become increasingly popular sports. These sports have also become more competitive and demanding on both the rider and the equipment. The demand continues in recreational and competitive snow and water sports.

In any form of transportation, there is an inherent element of "shock" that is produced by changing terrain conditions that transfers energy from the terrain ground or water into the vehicle that is speeding across it. In most forms of transportation, the vehicle has been equipped with some form of "shock absorbers" to smooth out the ride and to increase performance of both the equipment and the rider. It has become essential for the vehicle to be equipped with shock absorbers except in vehicles like the snowboards, skateboards, water skis and wakeboards. The present invention, as subsequently detailed, addresses this issue.

SUMMARY OF THE INVENTION

In accordance herewith, there is provided a shock absorbing system for a sport board which comprises:

(a) a longitudinally extending sport or sporting board having generally parallel, planar top and bottom surfaces, said bottom surface for engaging ground and water surfaces, (b) a longitudinally extending rocker platform having forward and rearward end sections, a bottom surface, and a top surface for receiving and supporting both feet of a sport board rider, (c) a rocker system interconnecting the center of the platform to the center of the sport board in a manner to define a hinge point between the platform and board which enables the end sections to "teeter" towards and away from the board, the feet of the sport board rider being supported on said forward and rearward sections and on opposite sides of the rocker hinge point, and (d) a pair of compressible members, one and the other compressible member being disposed, respectively, between the forward and rearward end sections and the top surface of the sport board to resist movement of the platform section towards the top surface of the sport board.

The rocker system or rocker, generally, comprises a pair of spaced apart first and seconds, or lower and upper, respectively, rocking members which are disposed transverse to the longitudinal axis of the board and rocker platform. The rocking members are hingedly interconnected through suitable means, such as a hinge pin, to enable the rocker platform to rotate or pivot relative to the sport board and the opposite ends of the rocker platform to "teeter" or "rock" towards and away from the sport board.

The first or lower rocking member is integral with or otherwise affixed to the board on the upper surface thereof.

The upper or second rocking member is affixed to a platform which is disposed above the board such that a space is created between the bottom of the platform and the upper surface of the board.

The upper rocking member and the lower rocking member include means for interdigitating, such as spacers or hinge members which cooperate to define a hinge. A hinge pin, or the like, interconnects the two together and defines a pivot about which the platform rotates.

In a first embodiment here, a pair of bladders or other compressible bodies are affixed to the upper surface of the board, one on each side of the hinge, in the space between the board and the platform. Thus, as the platform teeters or pivots between a forward and an aft position on the board, it will encounter one of the two bladders. Each bladder is inflatable and contains the same amount of fluid, such as air.

The bladders and hinge may be encased within a sealed shroud or the like to protect it from the elements.

It is further contemplated in the practice of the present invention that the present invention be part of an original equipment or that it be retrofitted wherein the bladders, rocker members, and platform are disposed on a mounting plate which is secured to a sports board.

For a more complete understanding of the present invention, references made to the following detailed description and accompanying drawings. In the drawings, like reference characters refer to like parts throughout the several views in which:

BRIEF DESCRIPTION OF THE DRAWINGS

FIG. 3 is a top view of a sports board having the lower rocker member mounted thereto;

FIG. 4 is a bottom review of the platform used herein having the upper rocker member mounted thereonto;

FIG. 5 is a partial side view showing the platform and the hinge pinhole;

FIG. 6 is a plan view, partly exploded, showing the hinge pin and the air bladders used herein;

FIG. 7 is a perspective view of a sleeve;

FIG. 8 depicts the rubber outer containment housing or shroud with upper and lower rubber seals and valve ports;

FIG. 9 is a front view of the upper and lower rocker members;

FIG. 9A is a front view of a spacer;

FIG. 10 is a side view of an air bladder; and

FIG. 11 is a side view of a second embodiment hereof.

DETAILED DESCRIPTION OF THE PREFERRED EMBODIMENT

Figure 1:
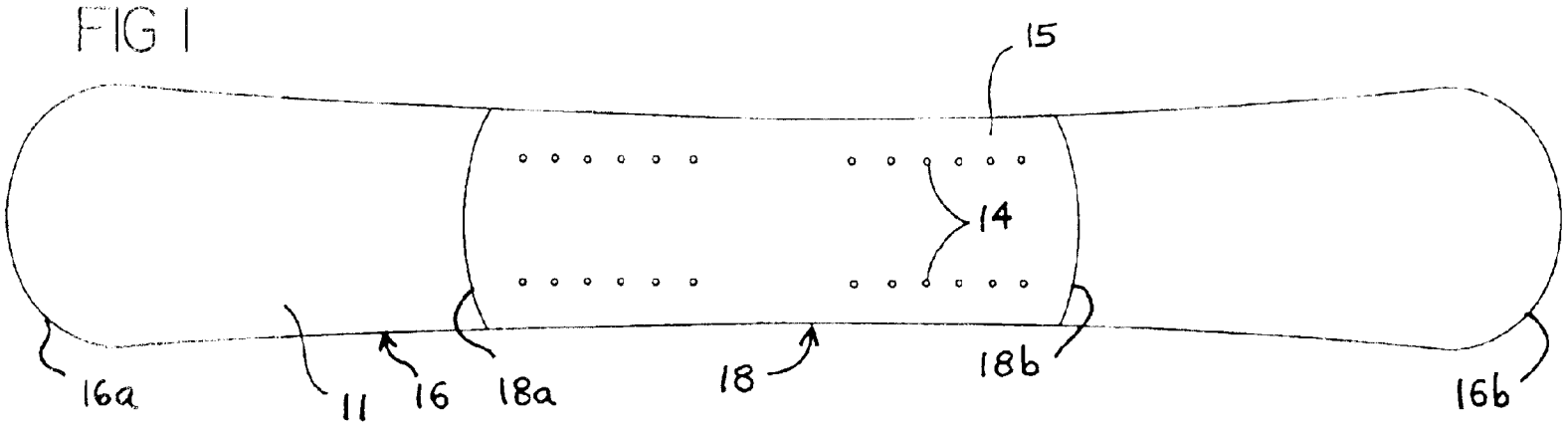
FIG. 1 is a top view of a sports board for use in the present invention.

Now, in accordance with the present invention, and with reference to the drawing, in particular FIGS. 1–10, there is depicted therein a sports board, generally, denoted at 16. The sports board 16 hereof may comprise a ski board, skate board, water board, wave board, ski, or any other similar type of board which is used in various ground and aquatic sports. The present invention is contemplated for use in connection with and conjointly with any one of such type boards. Thus, the board 16 shown herein is a snowboard for illustrative purposes only. However, it is to be understood that the present invention is applicable to any other type of board such as those alluded to hereinabove.

Mounted in juxtaposed relation atop and centrally of the sport board 16 is a rocker platform 18 upon which both feet of a sport board rider are placed, as described further herein below. As can be seen, the sport board 16 and the rocker platform 18 are generally oblong in shape, symmetrically disposed along a longitudinal axis extending between the ends of the members, and extend longitudinally between opposite longitudinal ends. In the embodiment shown, the lateral sides of the rocker platform 18 and the sport board 16 are generally complementary with one another and the rocker platform 18 is about one-third the length of and centered within the middle third of the sport board 16.

The sport board 16 hereof extends longitudinally between opposite ends 16*a* and 16*b*, is generally oblong in shape and symmetrically disposed about a central longitudinal axis, and has an upper surface 11 and a lower surface 13. The surfaces 11 and 13 are generally planar and parallel to one another except for respective forward and rearward end sections which curl upwardly from the plane of the upper surface 11 (shown best by reference to FIG. 2).

Figure 2:
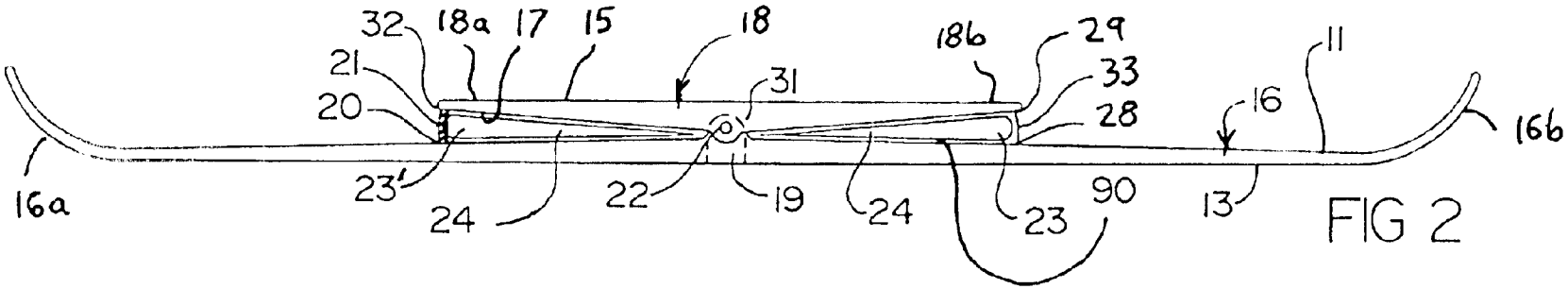
FIG. 2 is a side view of a sports board having the rocker system hereof mounted thereto.

As shown in FIGS. 2 and 5, the rocker platform 18 extends longitudinally between opposite ends 18*a* and 18*b*, and has a generally planar upper surface 15 and a lower or bottom surface 17. The lower surface 17 of the platform 18 is disposed in facing relation with the upper surface 11 and forms a pair of substantially identical tapered spaces or cavities 90 between the board and platform and which extend outwardly and away from the upper and lower rocker members (or a fulcrum) 31 and 19 and towards the free ends 18*a* and 18*b* of the platform 18. The platform 18 is substantially bisected by the upper rocker member 31 (or fulcrum) into a pair of identical surface portions or sections 17*a* and 17*b* which taper from the fulcrum 31 to the respective opposite ends 18*a* and 18*b* of the platform 18.

Preferably and according to this invention there is provided a shock absorbing system or shock absorber defined by a rocker system or rocker, generally, denoted at 12 (see FIGS. 1 and 9). The rocker system 12 generally, comprises:

(a) a first or lower rocker member 19 which is associated with the sport board 16, (b) a second or upper second rocker member 31 which is associated with the rocker platform 18, (c) apertured hinge or flange elements 19*a* and 19*b* and 31*a* and 31*b*, respectively, extending from the rocker members 19 and 31, which interdigitate with one another to define, at least in part, portions of a through bore 35, and (d) a hinge pin 22 passable through the bore 35 formed by the apertures of the flange elements for interconnecting the hinge elements when interdigitated wherein to form a hinge joint or assembly.

In a first embodiment hereof, the lower rocker member 19 is secured to the board 16 by any suitable means and, preferably, is molded integrally with the board. The lower rocker member 19, generally, comprises a transverse body 19*c* extending laterally across the width thereof. The lower rocker member 19 further includes:

(a) the spaced apart flanges 19*a* and 19*b*, each flange 19*a* and 19*b* extending upwardly from the upper surface 11 of the sport board 16 and having an aperture formed therein, and (b) a plurality of cylindrical sleeves 26 which are mounted onto the transverse body 19*c* or are integrally formed therewith. The lower rocker member 19 forms a transverse fulcrum about which the platform teeters.

The sleeves 26, as noted, are cylindrical and have a hollow interior. The apertures of the sleeves 26 and the flanges 19*a* and 19*b* are co-axial with one another.

Disposed on either side of the fulcrum are compressible members 23 and 23'. Each compressible member is similar. The compressible members can comprise any suitable article such as a section of compressible foam, an inflatable bladder, or the like. Each of the bladders is independently inflatable with a suitable fluid such as water, air or the like. A valve member 24 associated with each bladder may be used to inflate and deflate its associated bladder, as desired. Preferably, in the practice of the present invention, each of the bladders contains the same amount of fluid so that they are substantially equal. Preferably, the bladders are air bladders. It is contemplated that the valves or valve members 24 will extend from their associated bladder through the platform 17 to facilitate accessibility thereto.

The compressible members are secured to the upper surface of the board by any suitable means such as through an anchor 30. Alternatively, the bladders may be secured to the upper surface 11 with a nylon hook and fastener (Velcro), gluing, or the like.

As noted, the upper rocker member 31 is constructed similar to the lower rocker member 19 and includes a transverse body 31*c*, a pair of spaced apart apertured flanges 31*a* and 31*b*, and (optionally) a plurality of spaced apart sleeves 27 which are mounted onto the body 19*c* or are integrally formed therewith. The body 19*c* is secured at the center of and extends laterally across the width of the platform 18 by any suitable means, and preferably is molded thereto. The flanges 31*a* and 31*b* (and sleeves 27) extend upwardly from the lower surface 17 of the rocker platform 18 and the apertures of the flanges 31*a* and 31*b* and the sleeves 27 are coaxial with one another. The upper rocker member 31 forms a part of the transverse fulcrum about which the platform 18 teeters The tapered surfaces 17*a* and 17*b* of the rocker platform 18 permit the space 90 between the lower surface 17 of the platform 18 and the upper surface 11 of the lower sport board 16 to reduce quickly when the forward and rearward end sections of the platform 18 "teeter" or alternately move upwardly and downwardly in a direction away from and towards the upper surface 11 of the sport board 16. Such teetering movement is resisted by the air bladders 23 and 23' disposed in the cavities 90.

The apertured flanges 19*a* and 19*b* (and sleeves 26) of the lower rocker member 19 and corresponding apertured flanges 31*a* and 31*b* (and sleeves 27) from the upper rocker member 31 are spaced in a manner such that they will interdigitate, with one another, resulting in the apertures therethrough being aligned with one another and for a through bore 35 for receipt of the hinge pin 22 to hingedly interconnect the platform to the lower rocker.

It is readily appreciated that the platform pivots about the pin 22 both fore and aft in the directions of the arrow A (FIG. 5).

It should be noted that only the apertured flanges 19*a* and 19*b* and 31*a* and 31*b* are necessary for hinged interconnection by the hinge pin 22. Additionally, the anchor 30 of the bladders 23 and 23' may suitably be provided with an aperture 30*a* (see FIG. 10) wherein to enable the hinae pin 22 to secure the bladders 23 and 23' to the rocker assembly 12. Optionally, a plurality of wear rings or spacers may be disposed between the flanges and sleeves to prevent wear or the like.

In order to maintain the rocker system 12 sealed from the elements and to maintain the integrity and pressure within the bladders 23 and 23', these elements are preferably sealingly enclosed and protected from exposure to the environment by a shroud or outer containment housing 33. As shown FIGS. 2 and 8, the sealing arrangement includes oval shaped rim seals 20 and 32, respectively, on the upper surface 11 of the sport board 16 and on the bottom surface 17 of the rocker platform 18, and a resilient containment shroud 33. The lower rim seal 20 is circumferentially disposed about the lower rocker member 19 and the upper rim seal 32 is circumferentially disposed about the upper rocker member 31. The containment shroud 33 includes lower and upper seal members or lips 28 and 29 with sealing being accomplished by snap-fitting together the lower seal member 28 and the rim seal 20 of the sport board 16 and snap-fitting together the upper seal member 29 and the rim seal 32 of the rocker platform 18.

FIGS. 2 and 8 illustrate, respectively, the sealed connection and the containment shroud 33. In FIG. 2, the containment shroud 33 is shown (in cross-section) to illustrate the wall 21 of the containment shroud conforming to the outer periphery of the platform 18 and encircling the bladders 23 and 23' in the cavities 90, and the upper and lower seal members or lips 28 and 29 interfitted into the rim seals 20 and 32. In order to accommodate the containment shroud 33, valve ports 25 are provided in the wall 21 of the containment shroud 33. The valves 24 extend from each of the bladders 23 and 23' and protrude through the ports 25, outwardly and away from the platform 18 to enable the valves to be connected to a suitable source of compressed air or other fluid (not shown). A pressure gauge or the like (not shown) can be operatively affixed to the valves to measure and control the pressure within the bladders.

Where used, the outer containment housing or shroud 33 is placed around the rocker assembly, the upper seal 29 and the lower seal 28 are snapped into the upper rim seal 32 and the lower rim seal 20, respectively, to form a seal that will protect all the components inside from water, snow, ice, etc. The outer containment housing thus includes a bead, i.e. upper and lower seals 28 and 29, that snaps into the rim seals all the way around the shock absorbing assembly to protect it from the elements. The outer containment housing is a continuous piece made of rubber, vinyl, nylon or other suitable water-impervious suitable material.

The shroud 33, being attached at both its top and bottom to the rocker assembly has a sufficient extension capability to allow full range of motion of the most forward part and most aft part of the platform.

With the board and the platform joined together, there is defined a unitary shock absorbing assembly. The board and the platform are free moving parts, able to teeter in opposite directions from one another.

The user, when deploying the present invention as a snowboard, is positioned on the platform, toes pointing to one lateral edge, and heels pointing to the other or opposite lateral edge, one foot forward of the fulcrum, and one foot aft of the fulcrum, and the feet at about a nominal 3°–35° angle to the length and the width of the platform, though this is dictated by the comfort desires of the user. When associated with a ski, the platform may be modified to include mounting holes 14, such as for securing a ski boot (not shown) or other like-footwear.

When used as water ski, the user has one foot forward of the fulcrum, centered on the platform and toes pointing toward the tip of the board, and the other foot aft of the fulcrum, centered on the platform and toes pointing toward the tip of the board.

As a kneeboard, the user is in the kneeling position, as a wake board, the user is in the same position as with a snowboard.

The present invention can be used to retrofit an existing sport boards. Thus, and shown in FIG. 11 and in a second embodiment hereof, generally, denoted at 210 there is provided a mounting plate 212 to which is secured the rocker system hereof. The mounting plate 212 is dimensioned to lie atop or be superposed a sport board (not shown). The mounting plate is secured to the sport board through any suitable means, such as threaded fasteners, adhesives, and the like. In all respects the shock absorbing system is the same as in the first embodiment.

While not shown, a containment shroud as described herein above may be circumferentially emplaced about the assembly 210 wherein to circumpose the mounting plate 212, the rocker platform 18, and protect the rocker system and air bladders 23 and 23' from the environment. Additionally, if desired, the air valves 24 for the air bladders may be provided atop the rocker platform 18 (see FIG. 11).

It is to be appreciated that there has been described herein a sports board which enables the user to ride on a "cushion of air" or other suitable fluid thereby softening the ride while at the same time providing a rigid toe-to-toe or heel-to-heel (edge-to-edge) ride providing improved performance.

Having, thus, described the invention what is claimed is:

1. A shock absorbing system for a sports board having a top surface and a bottom surface for engaging a ground or water surface, comprising:

(a) a rocker platform having forward and rearward end sections, a top surface for receiving, supporting and positioning both feet of a sport board rider, and a bottom surface, (b) a rocker assembly hingedly interconnecting the rocker platform to the top surface of the sports board, the rocker assembly enabling the forward and rearward end sections of the rocker platform to rotate towards and away from the top surface of the sport board and to support one and the other foot of the sport board rider, the hinge connection defining first and second spaces between the forward and rearward end sections of the rocker platform and the top surface of the support board, and the feet of the sport board rider being adapted disposed to be forward and rearward of the said rocker assembly atop a respective end section, and (c) a pair of compressible members, one compressible member being disposed forward of the rocker assembly and in said first space and the other compressible member being disposed rearward of the rocker assembly and in said second space, the pair of compressible members resisting relative closing movement between the platform and the board.

2. The shock absorbing system of claim 1 wherein said platform and said sport board extend longitudinally and are generally oblong in shape, wherein the outer periphery of the platform is enclosed within the outer periphery of said sport board, and the platform is centered between the opposite ends of the sport board and about one third the length of the sport board, and the rocker assembly comprises:

(a) a lower rocker member extending transversely to the longitudinal axis of the board, said lower rocker member being integral, at least in part, with said board, (b) an upper rocker member extending transversely to the longitudinal axis of the platform, said upper rocker member being integral, at least in part, with said platform, and (c) means for hingedly interconnecting the upper rocker member to the lower rocker member.

3. The shock absorbing system of claim 2 wherein the means for hingedly interconnecting comprises:

(a) a plurality of apertured first hinge elements integrally formed with the lower rocker member, the apertures of the first hinge elements being coaxially aligned with one another, (b) a plurality of apertured second hinge elements integrally formed with the upper rocker member, the apertures of the second hinae elements being coaxially aligned with one another, the second hinge elements being spaced apart a sufficient distance to interdigitate with the first hinge elements of the lower rocker member and form an elongated bore through said hinge elements, and (c) a hinge pin which projects through the elongated bore when the hinge elements are interdigitated wherein to interconnect the platform to the board.

4. The shock absorbing system of claim 1 wherein each of the compressible members comprises an inflatable air bladder.

5. The shock absorbing system of claim 1 which further comprises a shroud for encasing the shock absorbing system.

6. The shock absorbing system of claim 1 wherein the compressible members comprise a compressible foam.

7. The shock absorbing system of claim 1 which further comprises a mounting plate, the platform, the rocker assembly, and the compressible members being disposed on the mounting plate, and said mounting plate being securable to the sports board.

8. The shock absorbing system of claim 1 which further includes means for sealing the shock absorber system, said means for sealing including:

a first rim seal disposed on the top surface of said sport board, a second rim seal disposed on the bottom surface of said rocker platform, and a resiliently deformable annular containment shroud having opposite annular ends, the shroud having an annular wall sized to encircle and enclose the rocker system, one and the other annular end of the containment shroud defining, respectively, a lower seal member that is sealingly interlockable with the first rim seal and an upper seal member that is sealingly interlockable with the second rim seal.

9. A sport board for use by a rider standing thereatop when performing sport maneuvers, said maneuvers being performed on the water, the snow, the ground, and in the air, comprising:

upper and lower platforms, each said platform having top and bottom surfaces, a central section, and front and rear end sections disposed along a central longitudinal axis, the top surface of said upper platform being sized to simultaneously support and position both feet of the rider during use of and maneuvering of the sport board, first means for hingedly connecting the platforms together and in a manner that the opposite ends of the upper platform may rock towards and away from the lower platform, the first means including upper and lower rocker members extending, respectively, transversely of the upper and lower platforms, and a hinge pin for connecting the rocker members together, said rocker members, at least in part, being molded into and extending from a respective of the top surface of said lower platform and the bottom surface of said upper platform, said lower rocker member defining a fulcrum, and said upper rocker member substantially bisecting the bottom surface of the upper platform into a pair of identical surface portions which taper in a direction away from the fulcrum to a respective end of the upper platform, the feet of the rider being adapted to be positioned atop the top surface of the upper platform and on opposite sides of the fulcrum, the hinged connection forming a closable lateral space between each of said identical surface portions and the top surface of the lower platform, the lateral spaces extending in a direction away from the fulcrum towards a respective opposite end of the upper platform, a compressible air bladder disposed in each said space, said air bladders resisting closing movement of the surface portions towards the top surface of the lower platform caused by the rider's feet during rider maneuvers, and means for sealing and enclosing said first means, said compressible air bladders, and the spaces receiving said air bladders.

10. The improvement of claim 9, wherein said first means comprises each said rocker member including a body portion disposed in a respective platform, and a respective set of cylindrical elements that are spaced apart a sufficient distance to permit the cylindrical elements of one rocker member to interdigitate with the cylindrical elements of the other rocker member and form a continuous cylindrical bore extending along an axis transverse to the longitudinal axis, said hinge pin being disposed in said bore for connecting the rocker members together and the upper platform to the lower platform.

11. The improvement of claim 9, wherein each said bladder includes means for selectively pressurizing the bladder, as desired, to change the force of impact during rider maneuvers.

12. In a sport board having forward and rearward end sections, a central section, an upper surface and a lower surface adapted to engage a surface, said surface comprising ground or water, the improvement comprising:

a shock absorber system mountable as a unit to said sport board, said shock absorber system comprising:

a mounting plate having a central section between opposite ends thereof, means for mounting the mounting plate centrally of the upper surface of said sport board, a longitudinally extending rocker platform, said rocker platform having opposite ends, a top surface for supporting both feet of a rider, and a bottom surface divided into a pair of like-shaped end sections which taper longitudinally away from the center thereof and towards the opposite ends thereof, a hinge element for hingedly interconnecting the center of the rocker platform atop the central section of the mounting plate, the hinge element enabling the end sections of the rocker platform to pivot towards and away from the mounting plate and the interconnection defining on each side of the hinge element a closable space between the end sections of the rocker platform and the mounting plate, and a compressible member disposed in said each space.

13. The improvement of claim 12, further including means for at least partially enclosing and sealing, the means being disposed about said mounting plate, said rocker platform, said compressible members and the spaces receiving the compressible members.

* * * * *